US006883927B2

(12) United States Patent
Cunningham et al.

(10) Patent No.: US 6,883,927 B2
(45) Date of Patent: Apr. 26, 2005

(54) FRAME ASSEMBLY AND LIGHT FOR AN ELECTRICAL WALL CONDUIT

(75) Inventors: Vern Cunningham, Aurora (CA); Michael Gomes, Cambridge (CA)

(73) Assignee: Cube Investments Limited, Aurora (CA)

( * ) Notice: Subject to any disclaimer, the term of this patent is extended or adjusted under 35 U.S.C. 154(b) by 303 days.

(21) Appl. No.: 09/767,959

(22) Filed: Jan. 24, 2001

(65) Prior Publication Data

US 2001/0046130 A1 Nov. 29, 2001

Related U.S. Application Data

(60) Provisional application No. 60/179,143, filed on Jan. 31, 2000.

(51) Int. Cl.[7] ..... F21V 33/00

(52) U.S. Cl. ..... 362/95; 362/91; 362/96; 362/149; 362/800

(58) Field of Search ..... 362/95, 91, 419, 362/96, 276, 800, 149

(56) References Cited

U.S. PATENT DOCUMENTS

| | | | | |
|---|---|---|---|---|
| 2,580,056 A | * | 12/1951 | Wheeler, Jr. | |
| 2,749,428 A | * | 6/1956 | McCarthy | |
| 3,465,111 A | | 9/1969 | Breslin | |
| 3,739,226 A | * | 6/1973 | Seiter et al. | 315/86 |
| 4,000,405 A | | 12/1976 | Horwinski | |
| 4,038,582 A | * | 7/1977 | Horwinski | 315/129 |
| 4,213,063 A | | 7/1980 | Jones, Sr. | |
| 4,220,984 A | | 9/1980 | Truher et al. | |
| 4,255,780 A | * | 3/1981 | Sakellaris | 362/32 |
| 4,468,658 A | | 8/1984 | Rossin | |
| 4,514,789 A | * | 4/1985 | Jester | 362/95 |
| 4,664,457 A | | 5/1987 | Suchy | |
| 4,758,170 A | * | 7/1988 | Hayden | 439/142 |
| 4,931,911 A | | 6/1990 | Hanson | |
| 5,213,413 A | | 5/1993 | Weathers | |
| 5,349,146 A | * | 9/1994 | Radabaugh | 200/61.6 |
| 5,481,442 A | | 1/1996 | Dickie et al. | |
| 5,485,356 A | * | 1/1996 | Nguyen | 362/95 |
| 5,490,051 A | | 2/1996 | Messana | |
| 5,775,952 A | | 7/1998 | Lu | |
| 6,000,807 A | * | 12/1999 | Moreland | 362/95 |
| 6,010,228 A | * | 1/2000 | Blackman et al. | 362/95 |
| 6,350,039 B1 | * | 2/2002 | Lee | 362/95 |

* cited by examiner

*Primary Examiner*—Sandra O'Shea
*Assistant Examiner*—Jacob Y. Choi
(74) *Attorney, Agent, or Firm*—Robert H. Wilkes

(57) ABSTRACT

A frame assembly for covering a wall conduit having a connection to electrical power and a component associated with the wall conduit requiring access through the frame assembly is provided. The frame assembly comprises a light powered by an electrical circuit connected to the connection and a frame for housing the light. The frame has an opening allowing access to the component through the frame, a side and an aperture in the side allowing the light to illuminate a space outside the frame assembly through the aperture.

27 Claims, 13 Drawing Sheets

FRAME ASSEMBLY AND LIGHT FOR AN ELECTRICAL WALL CONDUIT

CROSS-REFERENCE TO RELATED APPLICATION

This application is entitled to the benefit of the filing date of U.S. provisional patent application No. 60/179,143 filed Jan. 31, 2000.

FIELD OF THE INVENTION

The field of the invention relates to a frame assembly and a light for a wall conduit for electrical circuits, in particular wall conduits for electrical outlets, light switches and built-in vacuum inlet wall valves.

BACKGROUND OF THE INVENTION

Illuminating devices which are used in association with wall conduits for electrical wall outlets are known. For example, a "night light" is a small electrical device which plugs into an electrical socket, providing a continual source of visible, but non-distracting light. A night light has a casing which holds a small light, an electrical circuit and an electrical plug for connection into the electrical outlet. However, there are disadvantages to a night light. The night light occupies a socket in the electrical outlet, thereby preventing other electrical devices from using the socket. Also, the night light has a physical profile that distinctly juts out from the electrical outlet, presenting a distraction from the generally flat form of the electrical outlet.

Illuminating wall adapters are also known in the art. U.S. Pat. No. 4,000,405 by Horwinski discloses a combined electrical receptacle adapter and light which plugs into a wall socket and provides a night light and access to multiple electrical sockets. However, the adapter is not permanently connected to the wall socket. Accordingly, the adapter may become dislodged from the wall socket. The adapter also has a physical profile which distinctly juts out from the electrical outlet.

Alternative devices providing illumination around wall connections for electrical circuits are desirable.

SUMMARY OF THE INVENTION

In a first aspect the invention provides a frame assembly for covering a wall conduit having a connection to electrical power and a component associated with the wall conduit requiring access through the frame assembly. The frame assembly has a light powered by an electrical circuit connected to the connection and a frame for housing the light. The frame has an opening allowing access to the component through the frame, a side and an aperture in the side allowing the light to illuminate a space outside the frame assembly through the aperture.

For the frame assembly, the frame may house the electrical circuit.

The electrical circuit may provide power to the light during a portion of the AC signal having a first polarity and may allow activation of a vacuum on a second portion of the AC signal having a second polarity.

The electrical circuit further may have a second electrical circuit to provide sufficient power for at least two lights.

The electrical circuit may control activation of the vacuum system and may provide power to the light.

The electrical circuit may have a control arrangement to selectively activate the light. The control arrangement may utilize a light sensor or a switch.

The electrical circuit may be connected to the light and electrical connections of the wall conduit in a series circuit arrangement.

The frame assembly may utilize a plurality of light emitting diodes to be the light.

The wall conduit may be a vacuum wall valve for a vacuum system, a wall outlet or an electrical switch.

In a second aspect of the invention, the frame assembly described above is provided. The frame assembly further comprises a cover plate for covering the frame and for providing access to the components of the wall conduit.

In other aspects the invention provides various combinations and subsets of the aspects described above.

BRIEF DESCRIPTION OF THE DRAWINGS

For a better understanding of the present invention and to show more clearly how it may be carried into effect, reference will now be made, by way of example, to the accompanying drawings which show the preferred embodiment of the present invention and in which.

In the drawings, like elements have like reference numerals (and individual elements bear unique alphabetical suffixes).

DETAILED DESCRIPTION OF THE EMBODIMENTS

Figure 1:
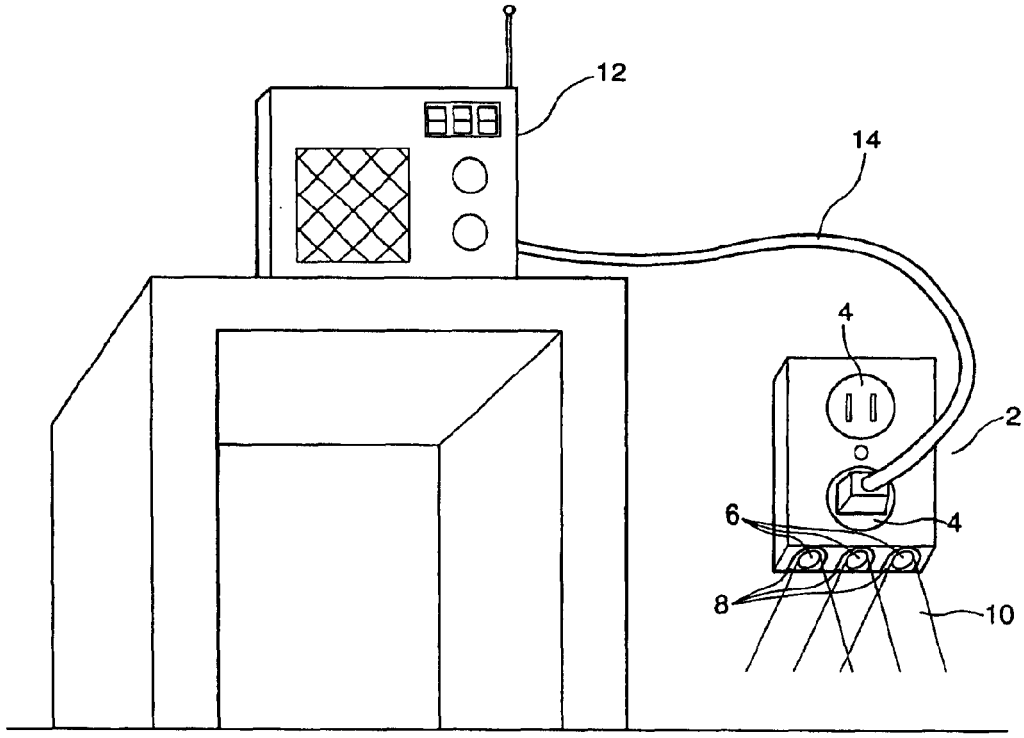
FIG. 1 is a pictorial representation of a frame assembly and light for an electrical wall outlet for an embodiment of the invention.

Referring to FIG. 1, inside frame assembly 2, lights 6 are connected via a light circuit (60, FIG. 3*a*) to a power circuit (66, FIG. 3*a*) which is connected to the household power supply (not shown) associated with wall outlet 4. Further details of the light circuit 60 and the power circuit 66 are provided later. Lights 6 shine through apertures 8, providing field of illumination 10 to the exterior of frame assembly 2. Wall outlets 4 provide electrical connections through frame assembly 2 to the household power supply for electrical devices, such as radio 12. Power cord 14 plugs into lower wall outlet 4 as shown. In this embodiment, lights 6 are continually powered. It can be appreciated that a control arrangement may be provided which allows lights 6 to be activated through a switch arrangement, through a timing arrangement, through a light detection arrangement, through a motion detection arrangement, or some other control arrangement.

Figure 2:
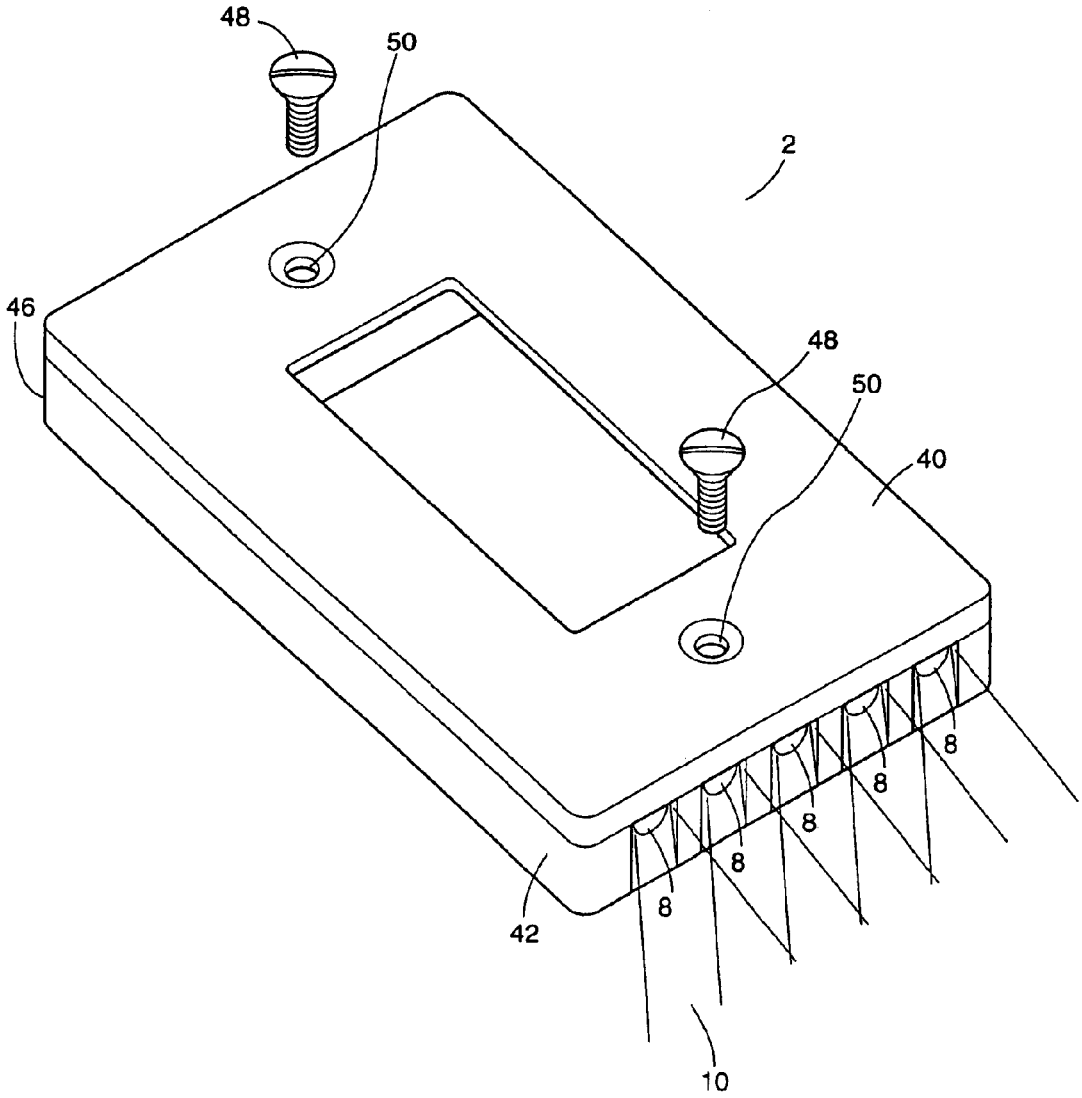
FIG. 2 is a profile view of a frame assembly and light for an electrical wall outlet for an embodiment of the invention of FIG. 1.

Referring to FIG. 2, cover 40 fits over frame 42. In the preferred embodiment, cover 40 is a standard-form cover for electrical outlets. Frame 42 is rectangular and is shaped to fit over standard wall conduits for an electrical outlet (not shown). Frame 42 also has sufficient depth on side 46 to enable lights 6 (not shown) to be housed inside frame 42.

Cover 40 mounts on top of frame 42, allowing access to connections 58 of wall outlet 52 through opening 94. Apertures 50 on cover 40 align with screw holes 96 on wall outlet 52. Screws, not shown (but see screws 49, FIG. 12), or other suitable fasteners, may be used to secure cover 40 and wall outlet 52 together.

Figure 3A:
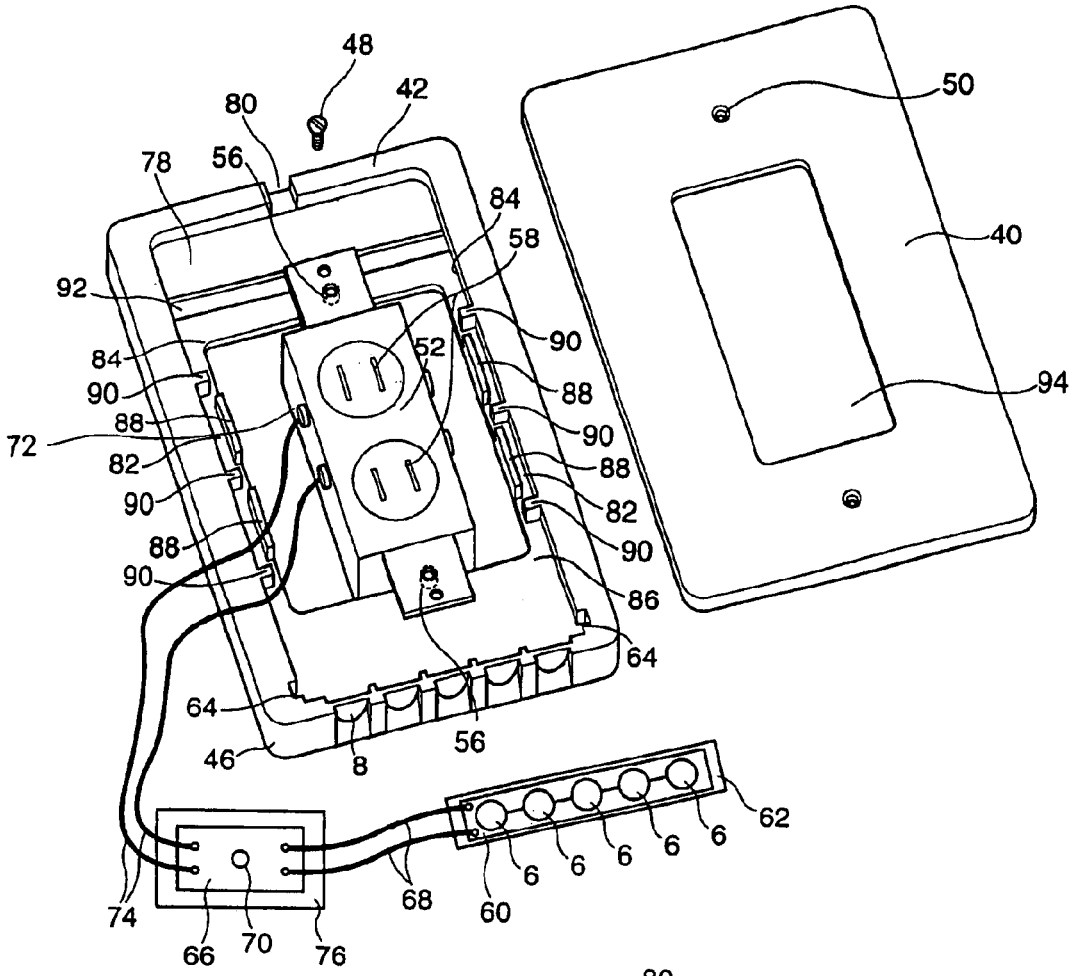
FIG. 3*a* is an exploded profile view of a frame assembly and light for an electrical wall outlet for an embodiment of the invention of FIG. 2.
Figure 3B:
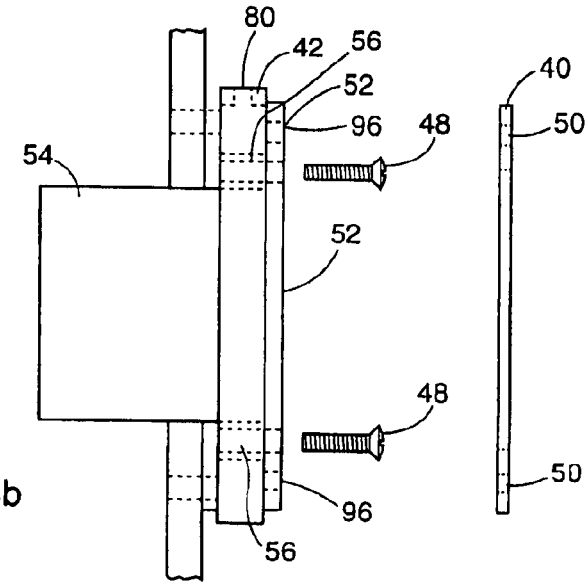
FIG. 3*b* is side view of a frame assembly and light for an electrical wall outlet for an embodiment of the invention of FIG. 2.

Referring to FIGS. 3*a* and 3*b* wall outlet 52 is mounted to electrical box 54 via screws 48 inserted through hollow spacers 56 on frame 42. Hollow spacers 56 allow connections 58 of wall outlet 52 to be flush with the front surface of cover 40. This provides a sleek appearance for the frame assembly 2 when installed.

Cover 40 mounts on top of frame 42, allowing access to connections 58 of wall outlet 52 through opening 94. Apertures 50 on cover 40 align with screw holes 96 on wall outlet 52. Screws 48, or other suitable fasteners, may be used to secure cover 40, frame 42 and wall outlet 52 together.

Lights 6 are part of light circuit 60. Further detail on light circuit 60 is provided later. Light circuit 60 is etched in printed circuit board 62 (PCB 62). PCB 62 is mounted in frame 42 below slots 64 and is oriented to have lights 6 facing downward towards apertures 8.

Light circuit 60 is supplied power by power circuit 66. Wire pair 68 provides electrical connections from power circuit 66 to light circuit 60. In the preferred embodiment, power circuit 66 has light sensor 70 which allows selective activation of light circuit 60. Power circuit 66 is connected to power terminals 72 of wall outlet 52 by second connection wire pair 74. Power terminals 72 are connected to a 120 volt AC signal (not shown) according to methods known in the art. Power circuit 66 receives the 120 volt AC signal present at power terminals 72, creates a 24 volt AC signal from the 120 volt signal and provides the 24 volt signal to light circuit 60. Further detail on power circuit 66, including power signals and light sensor 70 is provided later.

Power circuit 66 is mounted on second PCB 76. Second PCB 76 is mounted in frame 42 in space 78 such that light sensor 70 is oriented upwards to receive ambient light from outside frame 42 through conduit 80.

When first and second PCBs 62, 76 are mounted in frame 42, first and second wire pairs 68, 74 may be routed through wire routing channel 82 formed by the interior lateral edges 84 of frame 42, base plate 86 and side railings 88 extending upwardly from base plate 86. Flanges 90 extending into the routing channel 82 from the interior lateral edge 84 provide friction fit contact points in the routing channel for wire pairs 68, 74.

Top railing 92 in frame 42 provides a physical barrier between second PCB 76 (when installed) and wall outlet 52. This is a requirement for the safety code in some jurisdictions. If a component in power circuit 66 fails and physically disintegrates (e.g. explodes or melts), top railing 92 protects wall outlet 52 from the failed component, thereby preventing a potential fire or an electrical short hazard. Other isolation means may be used.

Figure 4:
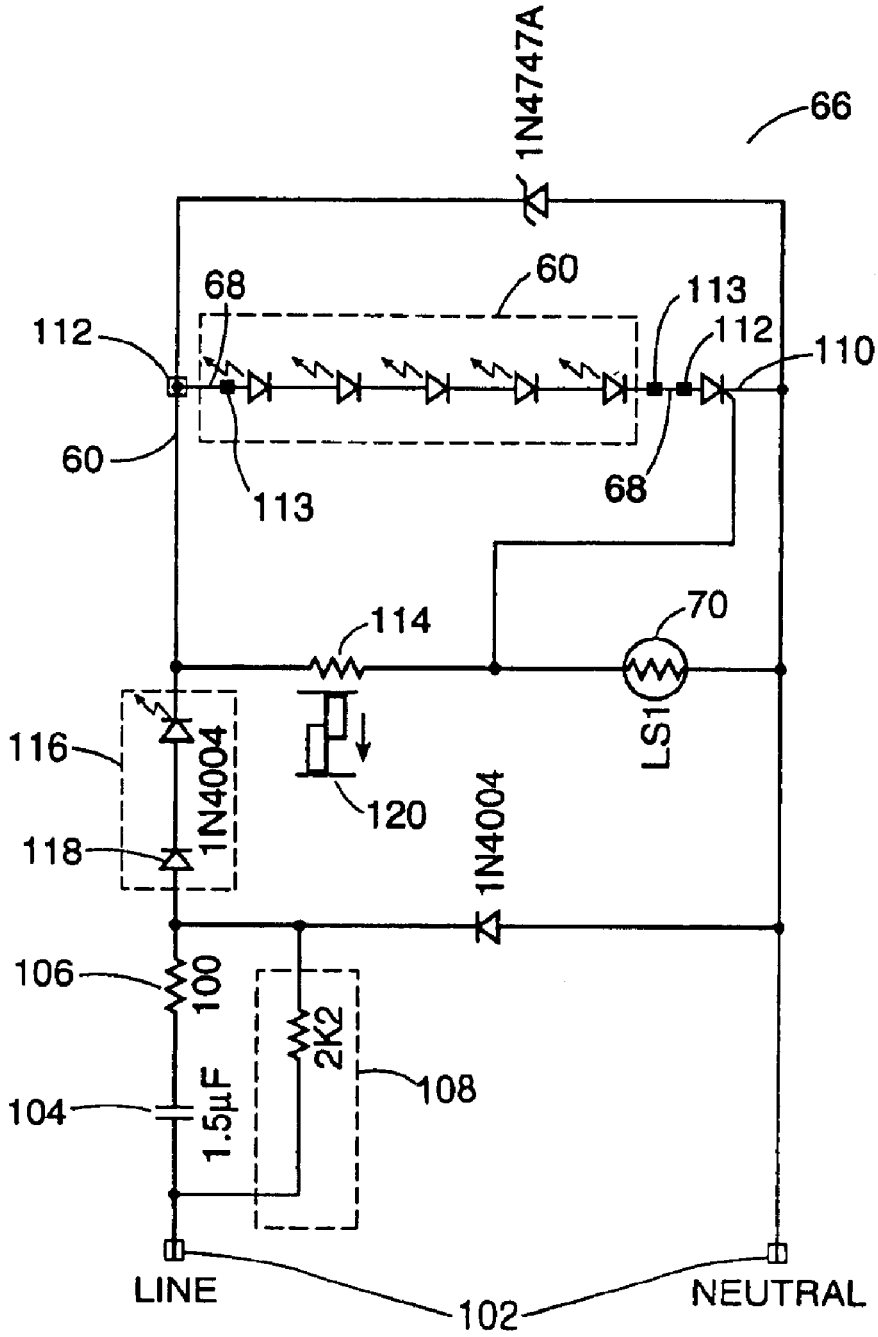
FIG. 4 is a schematic diagram of an electrical circuit for power and light circuits for an embodiment of the invention of FIG. 1.

Referring to FIG. 4, light circuit 60 comprises five LEDs 6 connected in series. Accordingly, all five LEDs 6 will conduct when there is a sufficient voltage across them. Given a conventional 0.7 volt drop across each LED 6, a total of 3.5 volts (five LEDs×0.7 volt per LED) must be provided across all five LEDs 6. It can further be appreciated that other circuit designs may be used which are known in the art which would cause activation of a number of LEDs when a sufficient voltage is provided to the circuit. It can still further be appreciated that other embodiments include light circuits 60 having less or more than five LEDs.

Power circuit 66 comprises the components outside circuit 60 in FIG. 4. In power circuit 66, capacitor 104 and resistor 106 cause the line voltage 102 in power circuit 66 to drop to a level which can be handled by light circuit 60. Alternatively, capacitor 104 and resistor 106 may be replaced by single resistor 108. Single resistor 108 must be of sufficient resistance to drop the voltage to the required operating levels of light circuit 60. It can be appreciated that a variety of known circuit arrangements are available which may be utilized to effectively drop the 120 volt AC signal to a signal which can be used by light circuit 60.

Light sensor 70 and SCR 110 in power circuit 66 provide power to light circuit 60. In situ, when light sensor 70 senses sufficient ambient light entering from conduit 80 (FIG. 3*a*), light sensor 70 acts as a short circuit. Accordingly, an enabling control signal is not provided to SCR 110 and SCR 110 does not conduct. However, as light sensor 70 detects decreasing levels of light, its resistance increases. In the absence of light, light sensor 70 appears to be an open circuit. Accordingly, when sufficient absence of light is detected by light sensor 70, sufficient current flows to SCR 110 to enable SCR 110 to conduct. After SCR 110 conducts, power is provided to light circuit 60 through from terminals 112 in power circuit 66, through wire pair 68 to terminals 113 in light circuit 60. Resistor 114 provides current adjustment to light sensor 70. Resistor 114 may be selected to sensitize light sensor 70 to a specific amount of light.

Optionally, LED 116 and diode 118 may be provided in power circuit 66 as a supplementary light source for light sensor 70. LED 116 may be directed to light sensor 70, thereby providing a supplementary arrangement to control light sensor 70. In an optional arrangement, LED 116 is continually energized in power circuit 66. The amount of light from LED 116 which is provided to light sensor 70 may be controlled by adjustable blind 120.

As described earlier, it can be appreciated that other control arrangements in power circuit 66 may be utilized which selectively provide power to light circuit 60. It can further be appreciated that power circuit 66 may not utilize any control arrangements to control power to light circuit 60.

Figure 5:
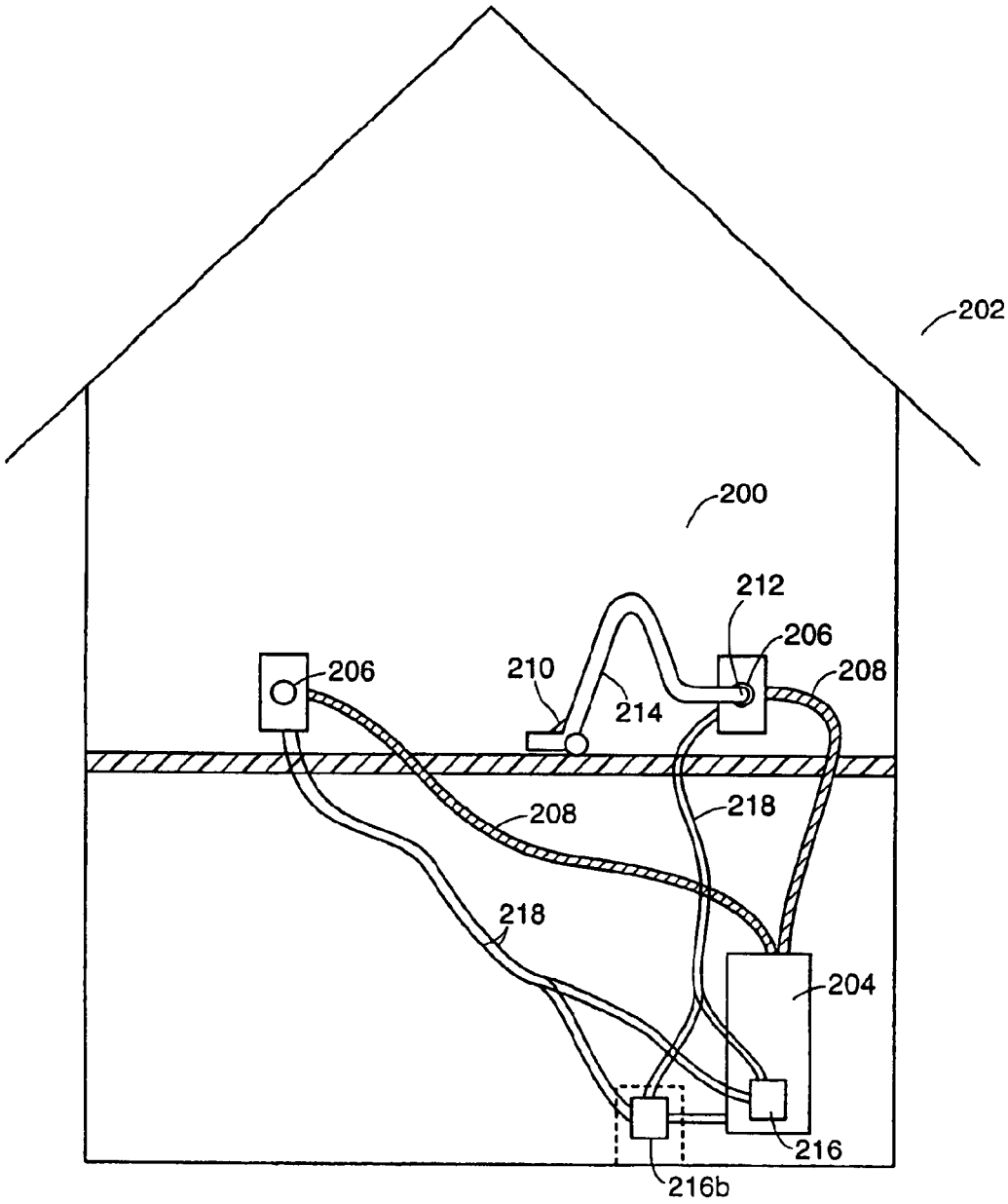
FIG. 5 is a cut-away pictorial view of aspects of a built-in vacuum system.

Referring to FIG. 5, built-in vacuum system 200 is installed in house 202. Central canister unit 204 has a central motor (not shown) to create a vacuum for suction for built-in vacuum system 200. Throughout house 202, a plurality of vacuum wall valves 206 are mounted on walls. Each vacuum wall valve 206 is connected to a hose 208 to transport materials vacuumed by head unit 210 to central canister unit 204. Head unit 210 provides the pick-up mechanism for vacuuming an area. To operate head unit 210 at a location, connecting element 212 of head unit 210 is inserted into vacuum wall valve 206. Then, switch 214 on head unit 210 is engaged to remotely activate central canister unit 204. Operational aspects of switch 214 are described later. Thereafter, a vacuum suction is created from central canister unit 204, through hose 208 to head unit 210 to allow an operator to position head unit 210 to vacuum a desired area.

Controller 216 provides power to central canister unit 204 and provides an electrical interface for switch 214 to toggle activation of power for central canister unit 204. Each vacuum wall valve 206 provides control connections (224, FIG. 6) which are connected to controller 216 via wiring pairs 218.

Alternative controller 216*b* is shown. Wiring pairs 218 may connect to alternative controller 216*b*. Alternative controller 216*b* provides a similar functionality as controller 216. Further detail on alternative controller 216*b* is provided later.

Figure 6:
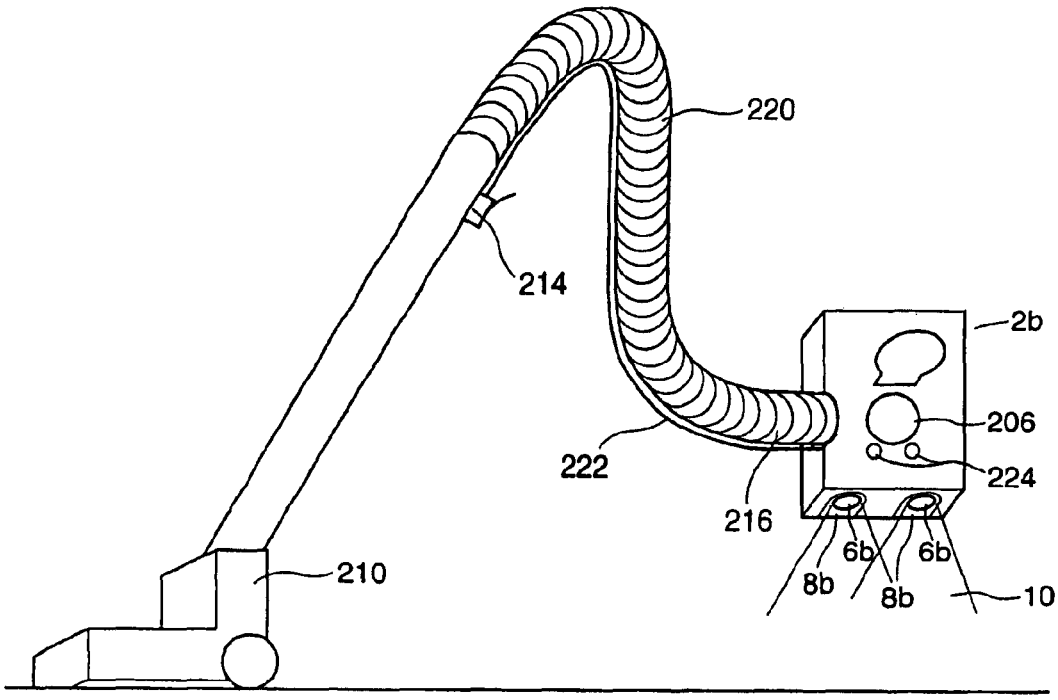
FIG. 6 is a pictorial view of a built-in vacuum system of FIG. 5.

Referring to FIG. 6, vacuum head unit 210 is connected to vacuum hose 220. The connecting element 212 is adapted to connect to vacuum wall valve 206. Wires 222 connect switch 214 to control connections 224 of vacuum wall valve 206. When the connecting element 212 is inserted into vacuum wall valve 206, an electrical circuit is established amongst switch 214, wires 222, control connections 224, wires 218 and controller 216. The above connection and power aspects for vacuum system 200 are known in the art. Switch 214 may be manually activated by the operator of vacuum head unit 210 to start the motor in central canister unit 204. It can be appreciated that switch 214 may be changed to a permanent connection allowing activation of central canister unit 204 as soon as wires 222 connect to control connections 224.

Figure 7A:
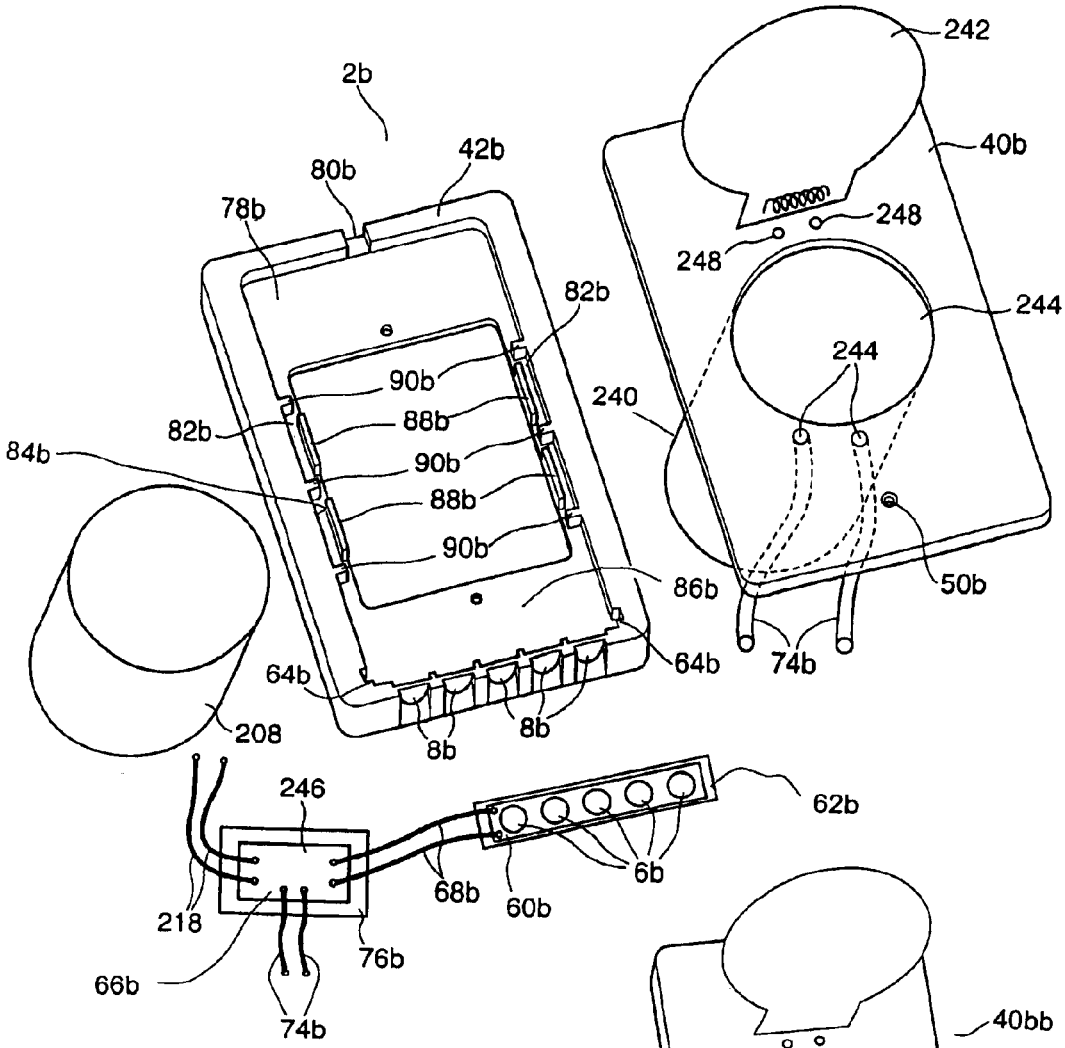
FIG. 7*a* is a pictorial representation of a frame assembly and light for an inlet wall valve for an embodiment of the invention of FIG. 6.

Referring to FIG. 7*a*, lights 6*b* illuminate through apertures 8*b* on frame assembly 2*b*, providing a field of illumination 10 to the exterior of frame assembly 2*b*. In the preferred embodiment, lights 6*b* are illuminated continuously and operate regardless whether connecting element 212 is connected to vacuum wall valve 206.

Frame assembly 2*b* for vacuum wall valve 206 comprises cover 40*b* and frame 42*b*. Cover 40*b* has apertures 50*b* and has hollow conduit 240 with opening 244. The distal end of hollow conduit 240 cooperates with hose 208. Lid 242 is pivotally attached to cover 40*b*. In a first position, lid 242 can be lowered to cover opening 244. In a second position, lid 242 is pivoted away from opening 244 allowing access to opening 244.

When using head unit 210, lid 242 is raised from its first position and connecting element 212 is inserted into opening 244. Terminals in connecting element 212 (not shown) connect with control connections 224.

Figure 7B:
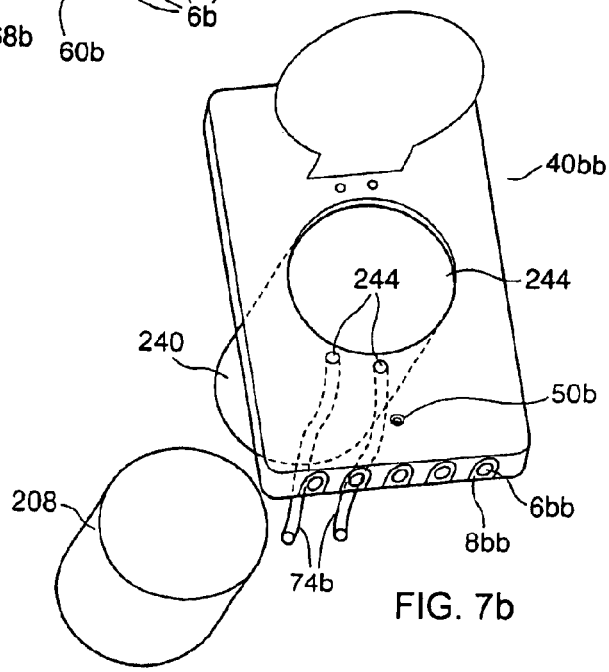
FIG. 7*b* is a pictorial representation of a frame assembly and light for an inlet wall valve for an embodiment of the invention of FIG. 6.

Referring to FIG. 7*b*, in another embodiment, lights 6*bb* are incorporated into cover 40*bb*. Apertures 8*bb* are also incorporated into cover 40*bb*. In this embodiment, structural features of frame 42*b* are incorporated into cover 40*bb* so that cover 40*bb* is a single piece which fits over the wall conduit and cooperates with hose 208.

In a further embodiment power terminals 248 are provided in cover 40*b*, which connect to a 120 volt AC power supply. Power terminals 248 may be accessed by head unit 210 to provide 120 volt AC power to a powered beater brush (not shown).

Lights 6*b* are part of light circuit 60*b*. Light circuit 60*b* is etched in PCB 62*b*. PCB 62*b* is mounted in frame 42*b* between slots 64*b* and is oriented to have lights 6*b* facing downward towards apertures 8*b*.

Light circuit 60*b* is supplied power by controller 216 through wires 218. Wires 74*b* connect with control connections 224. Light sensor circuit 246 provides a light-sensitive activation circuit for light circuit 60*b*. Light sensor circuit 246 is mounted on second PCB 76*b*. Second PCB 76*b* is mounted in frame 42*b* in space 78*b* such that light sensor 70*b* is oriented upwards and can receive ambient light in a room through conduit 80*b*. When connecting element 212 of head unit 210 is inserted into opening 244, a circuit is completed between switch 214 and light sensor circuit 246. Further detail on light circuit 60*b* and light sensor circuit 246 is provided later.

When first and second PCBs 62*b*, 76*b* are mounted in frame 42*b*, first and second wire pairs 68*b*, 74*b* may be routed in routing channel 82*b* in frame 42*b* formed by interior lateral edges 84*b*, base plate 86*b* and side railings 88*b* extending upwardly from base plate 86*b*. Flanges 90*b* extending inwardly from the interior lateral edge 84*b* provide friction fit contact points in the routing channel 82*b* for wire pairs 68*b*, 74*b*.

Figure 8:
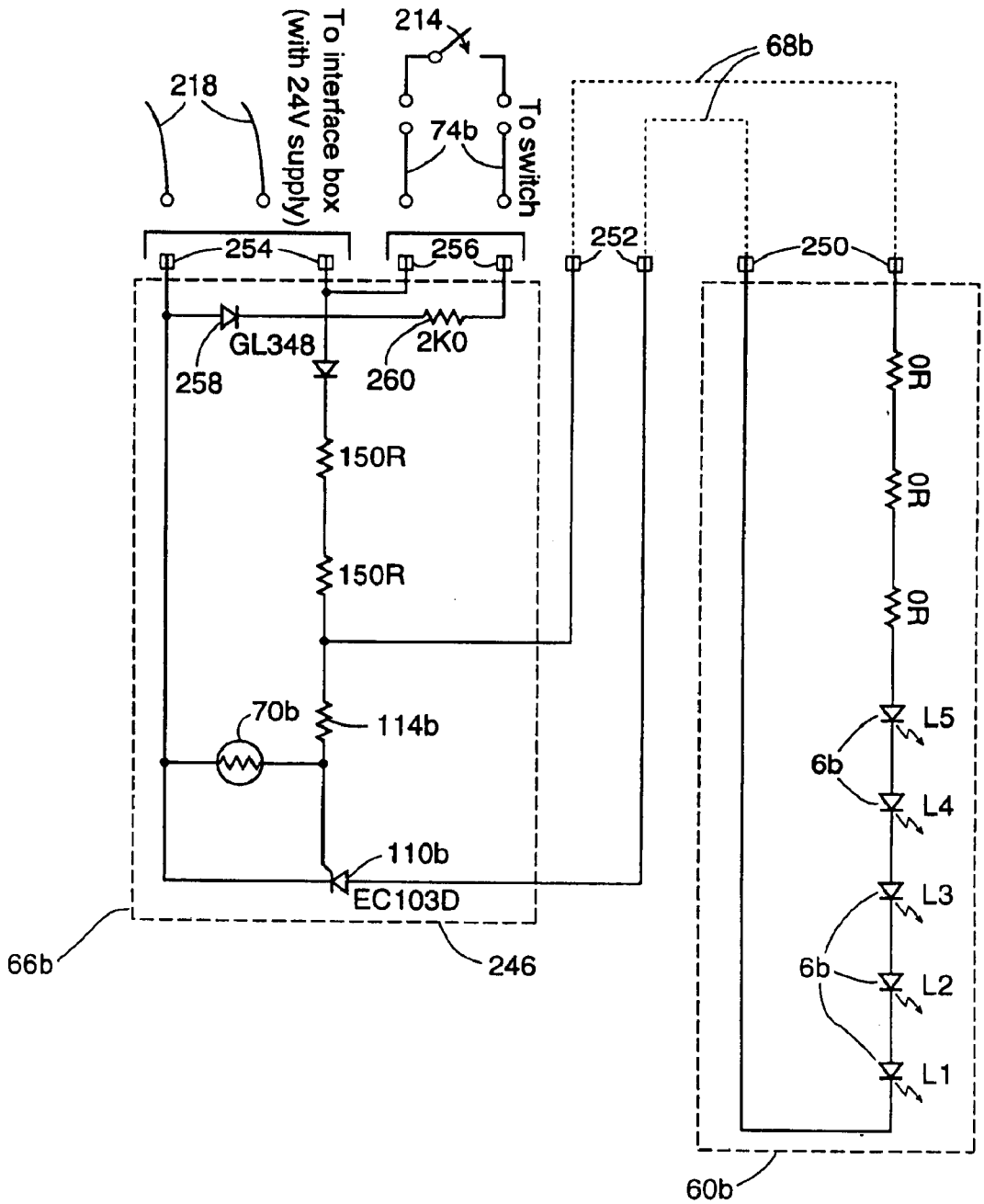
FIG. 8 is a schematic diagram of an electrical circuit for a for power and light circuits for an embodiment of FIG. 7.

Referring to FIG. 8, light circuit 60*b* comprises five LEDs 6*b* connected in series. Terminals 250 in light circuit 60*b* are connected to terminals 252 of power circuit 66*b* via wires 68*b*. Terminals 254 of power circuit 66*b* connect to wires 218 (FIG. 5) providing a connection to controller 216. Terminals 256 connect with connections 224 with wires 74*b* to provide a circuit with switch 214, diode 258 and resistor 260. Further detail on the operation of diode 258 is provided later.

In light sensor circuit 246, light sensor 70*b* and SCR 110*b* control when power in light sensor circuit 246 is provided to light circuit 60*b*. Resistor 114*b* may be selected to bias light sensor 70*b* to a sensitivity for a specific amount of light.

As described earlier in relation to power circuit 66, it can be appreciated that other control arrangements in light sensor circuit 246 may be utilized which selectively provide power to light circuit 60*b*. It can further be appreciated that light sensor circuit 246 may not utilize any control arrangements to control power to light circuit 60*b*. A simplified power circuit without control arrangement would comprise diode 258, resistor 260 and terminals 254 and 256.

Figure 9A:
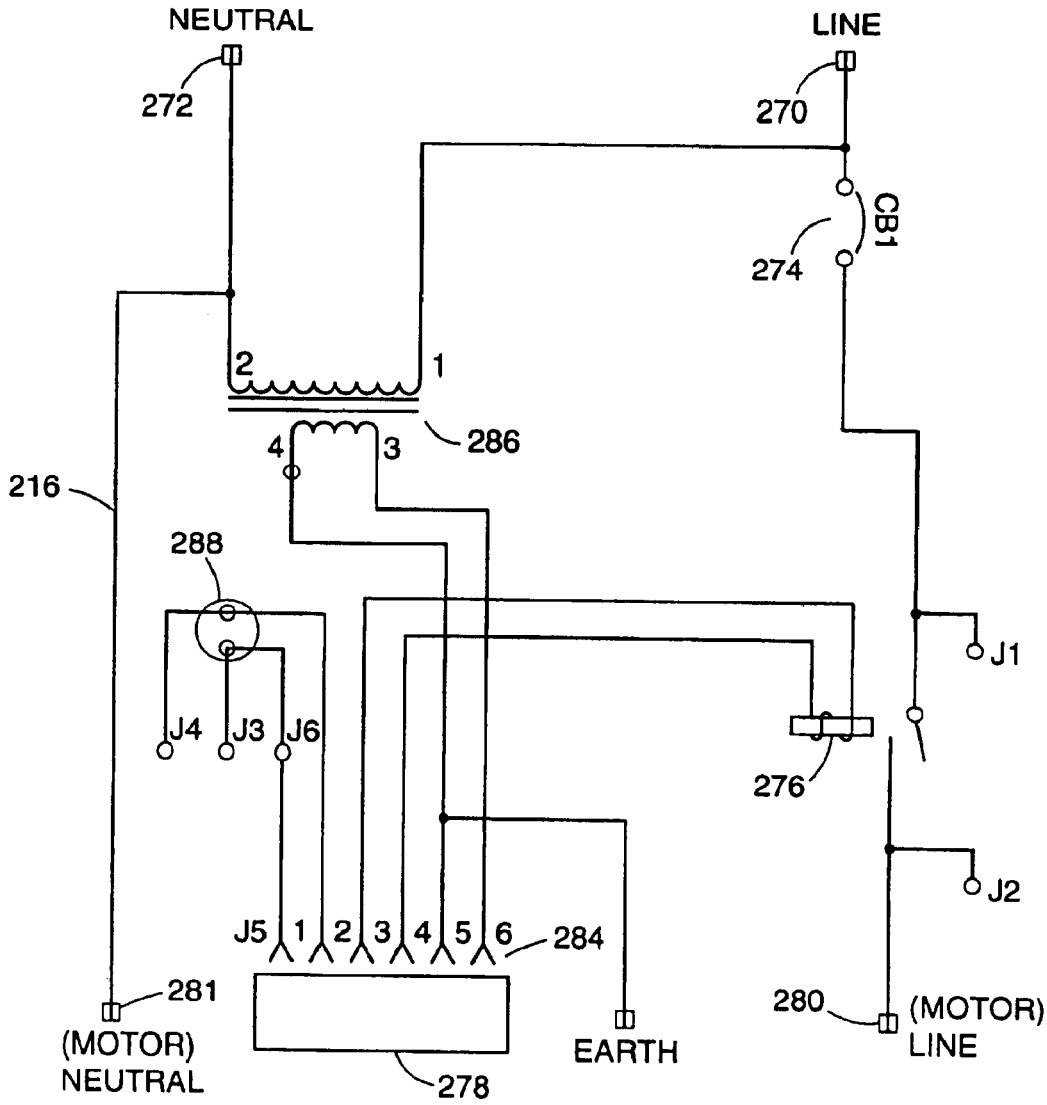
FIG. 9*a* is a schematic diagram of an electrical circuit for a controller for an embodiment of FIG. 7.

Referring to FIG. 9*a*, controller 216 has terminals 270, 272 connecting to a household 120 volt AC power signal. Controller 216 controls the activation of the central motor of the central canister unit 204 and controls the power provided to lights 6*b*. Circuit breaker 274 provides protection to controller 216 from electrical overloads. Relay 276 is selectively energized by auxiliary circuit 278 to allow transmission of a power signal from terminals 270, 272 to terminals 280, 281 to the central motor. Transformer 286 provides an AC power signal to auxiliary circuit 278 through terminals 286(3) and 286(4). In the preferred embodiment, transformer 286 provides a 24 volt AC power signal to auxiliary circuit 278. It can be appreciated that auxiliary circuit 278 and transformer 286 can be designed and selected to operate at a variety of voltage levels. Further detail on auxiliary circuit 278 is provided later. Connector 288 connects with wires 218 (FIG. 5).

Transformer 286 provides a 24-volt signal between terminals 286(3) and 286(4) when a 120-volt AC signal is present between terminals 270 and 272. Relay 276 is energized on the positive portion of an AC signal between terminals 286(3) and 286(4), via auxiliary circuit 278. Controller 216 interfaces to auxiliary circuit 278 through connector 290.

Figure 9B:
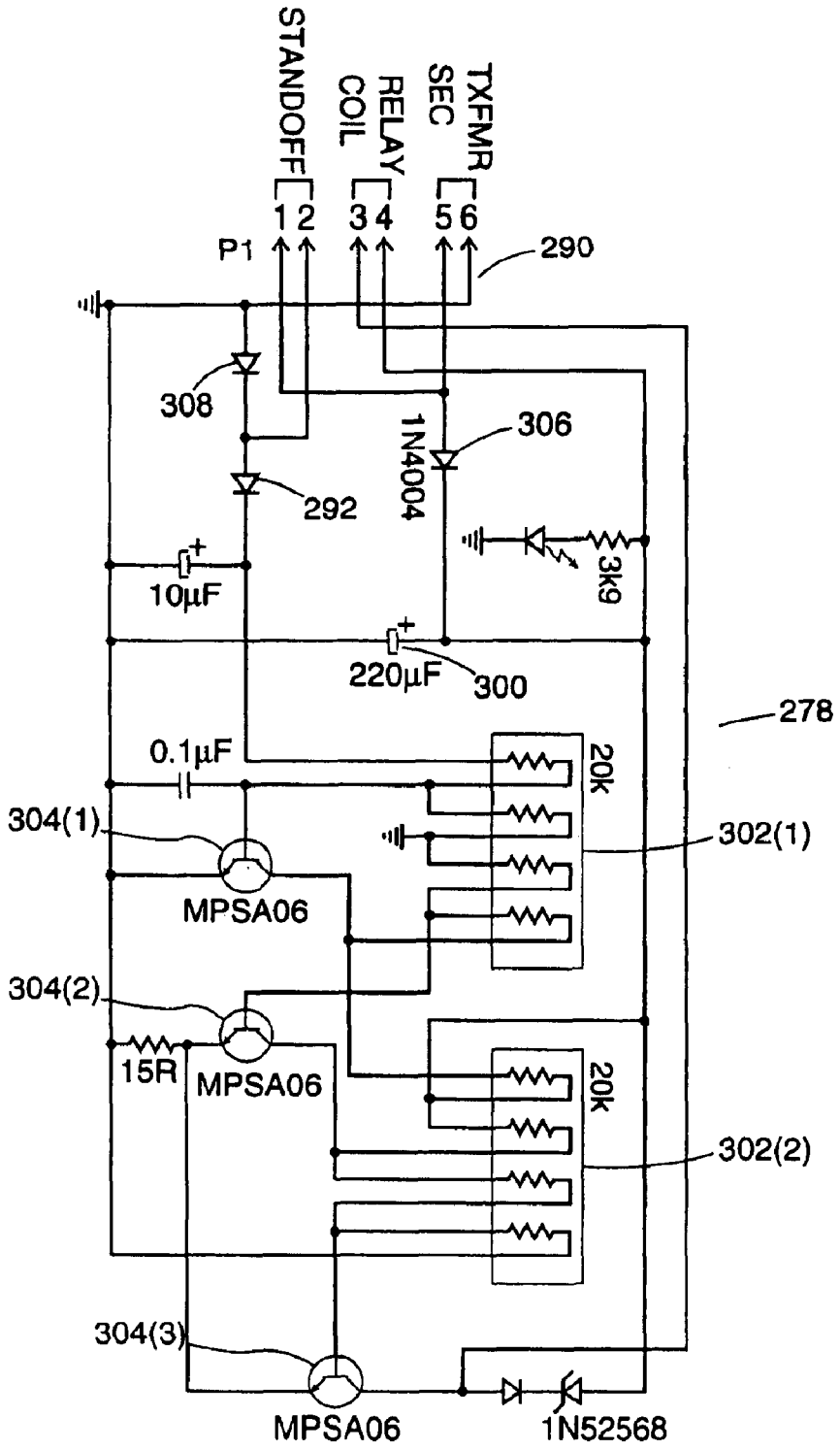
FIG. 9*b* is a schematic diagram of another electrical circuit for a controller for an embodiment of FIG. 7.

Referring to FIG. 9*b*, auxiliary circuit 278 provides: 1) a DC signal to energize relay 276 though terminals 290(3) and 290(4); and 2) sufficient current to activate light sets in circuit 60*b*.

Auxiliary circuit 278 received an AC signal from transformer 286 through terminals 290(5) and 290(6). In operation, the user closes switch 214, thereby shorting terminals 290(1) and 290(2). On a positive portion of the signal between terminals 290(5) and 290(6) diode 292 conducts, and capacitor 300 charges. The size of capacitor 300 is sufficiently large such that it will not discharge completely over one AC cycle. The AC signal then flows through resistors in resistor network 302(1), thereby firing transistor 304(1). The base of transistor 304(2) is connected with the collector of transistor 304(1) through resistor network 302(1). Accordingly, the activation of transistor 304(1) causes the deactivation of transistor 304(2). The base of transistor 304(3) is connected with the collector of transistor 304(2) through resistor network 302(2). Accordingly, when transistor 304(2) is turned off, transistor 304(3) is turned on and the signal at terminal 290(3) goes to a low value. Meanwhile, on the positive portion of the signal between terminals 290(5) and 290(6), diode 306 conducts, causing terminal 290(4) to go to a high value. As such, there is a positive signal between terminals 290(3) and 290(4), which is sufficient to energize relay 276. On the negative portion of the AC signal, the DC voltage stored in capacitor 300 flows through auxiliary circuit 278 allowing relay 276 to be energized.

Meanwhile, lights 6*b* are energized on the negative portion of the AC signal from transformer 286. As shown in FIG. 8, lights 6*b* are in a parallel circuit with switch 214 and diode 258 FIG. 8). Referring to FIG. 9, on the negative portion of the AC signal, a signal conducts through diode 308 to terminal 290(6). The diode 258 prevents current from flowing through switch 214, accordingly, current flows through light 6*b* causing lights 6*b* to conduct and illuminate.

Auxiliary circuit 278 thereby energizes relay 276 on the positive portion of an AC signal and power to light 6*b* on a negative portion of an AC signal. Auxiliary circuit 278 further provides sensing of closure of switch 214. All this is done with one wire loop, namely wires 218, wires 68, light circuit 60*b* and switch 214.

It can be appreciated that connector 284 allows a plurality of different circuits providing different functionality to interact with controller 216.

Figure 10:
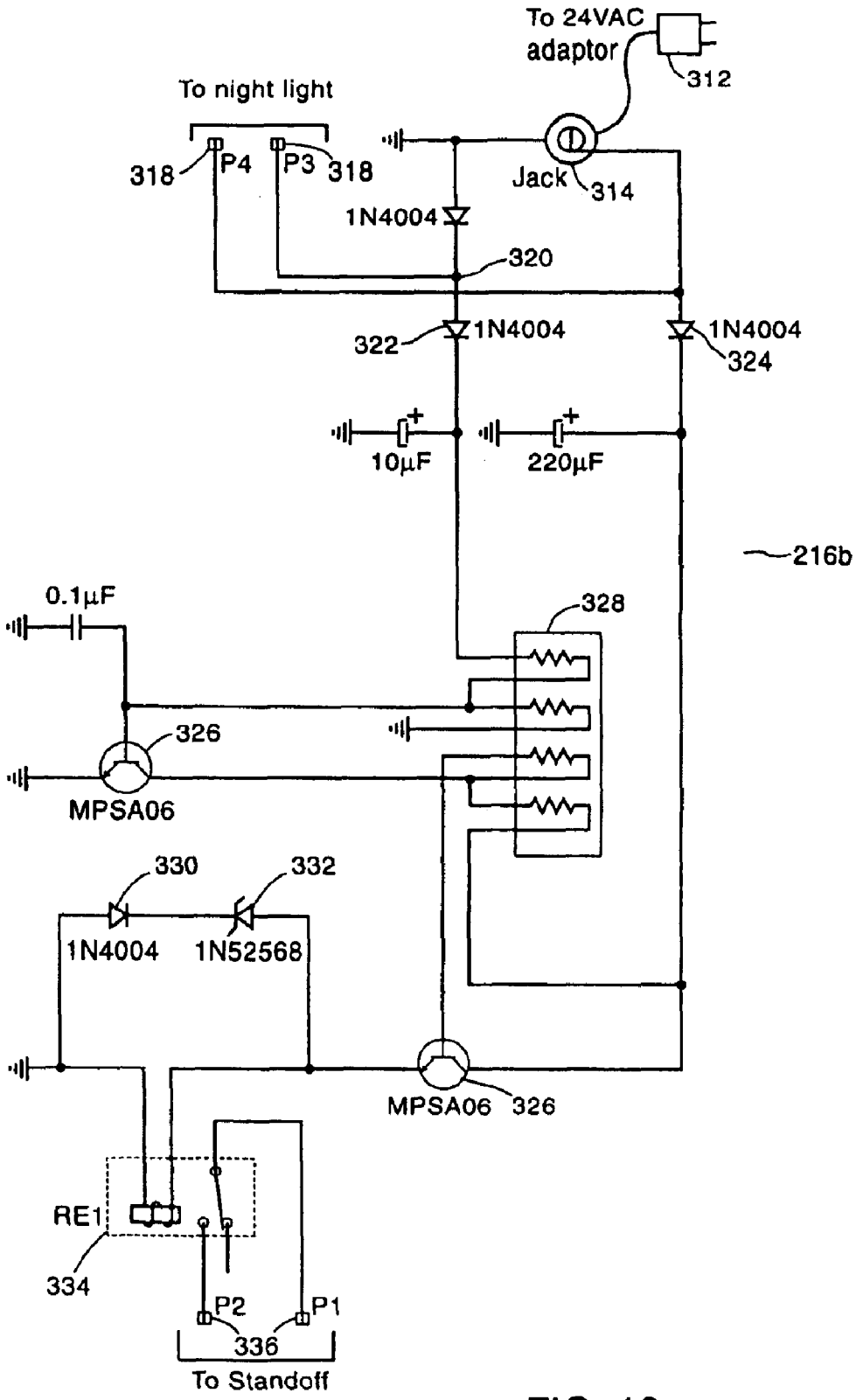
FIG. 10 is a schematic diagram of an electrical circuit for another controller for an embodiment of FIG. 7.

Referring to FIG. 10, alternative controller 216*b* utilizes 24 volt AC power adapter 312 to provide power for controller 216*b* through connector 314. From connector 314, the power signal is rectified by diode 316 and is provided to light circuit 60*b* (FIG. 7) via terminals 318. Light circuit 60*b* is mounted into frame 2*b* for vacuum wall valve 206.

The rectified power signal located between node 320 and connector 314 is further rectified by diodes 322, 324. A circuit comprising transistors 326, resistor networks 328, diode 330, zener diode 332 and relay 334 selectively provides power to terminals 336 when power adapter 312 energizes controller 216*b*.

Figure 11:
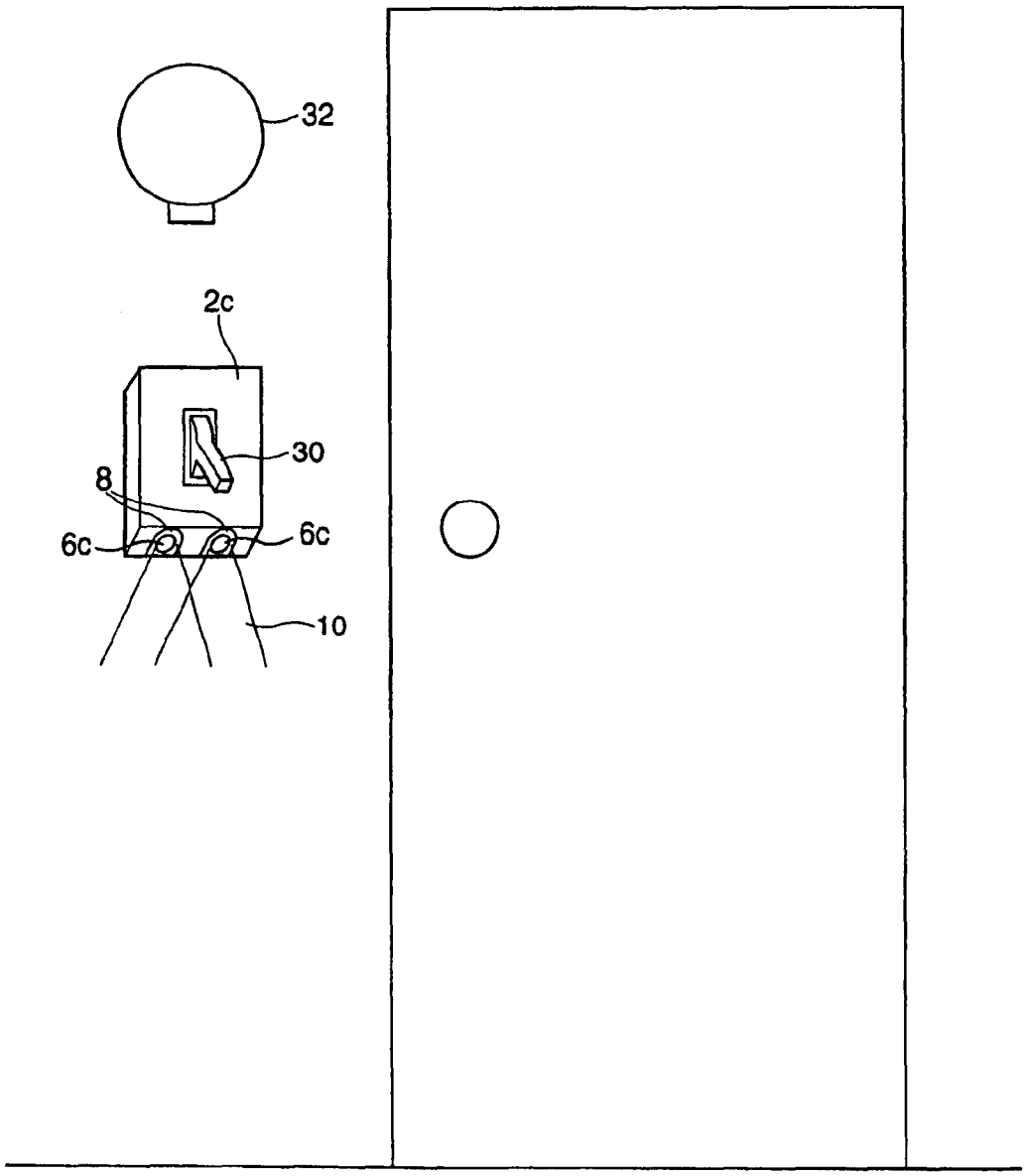
FIG. 11 is a pictorial representation of a frame assembly and light for a light switch embodiment of the invention.

Referring to FIG. 11, light switch 30 has frame assembly 2*c* covering the wall connection of light switch 30. As with the wall outlet 4 shown in FIG. 1, inside frame assembly 2*c* are lights 6*c* which are powered by an electrical circuit (not shown) connected to the household power supply (not shown). Lights 6*c* illuminate through apertures 8*c* located on frame assembly 2*c*, providing a field of illumination 10 to the exterior of frame assembly 2*c*. Light switch 30 controls light 32. Lights 6*c* are illuminated continuously and operate regardless of the position of switch 30.

Figure 12:
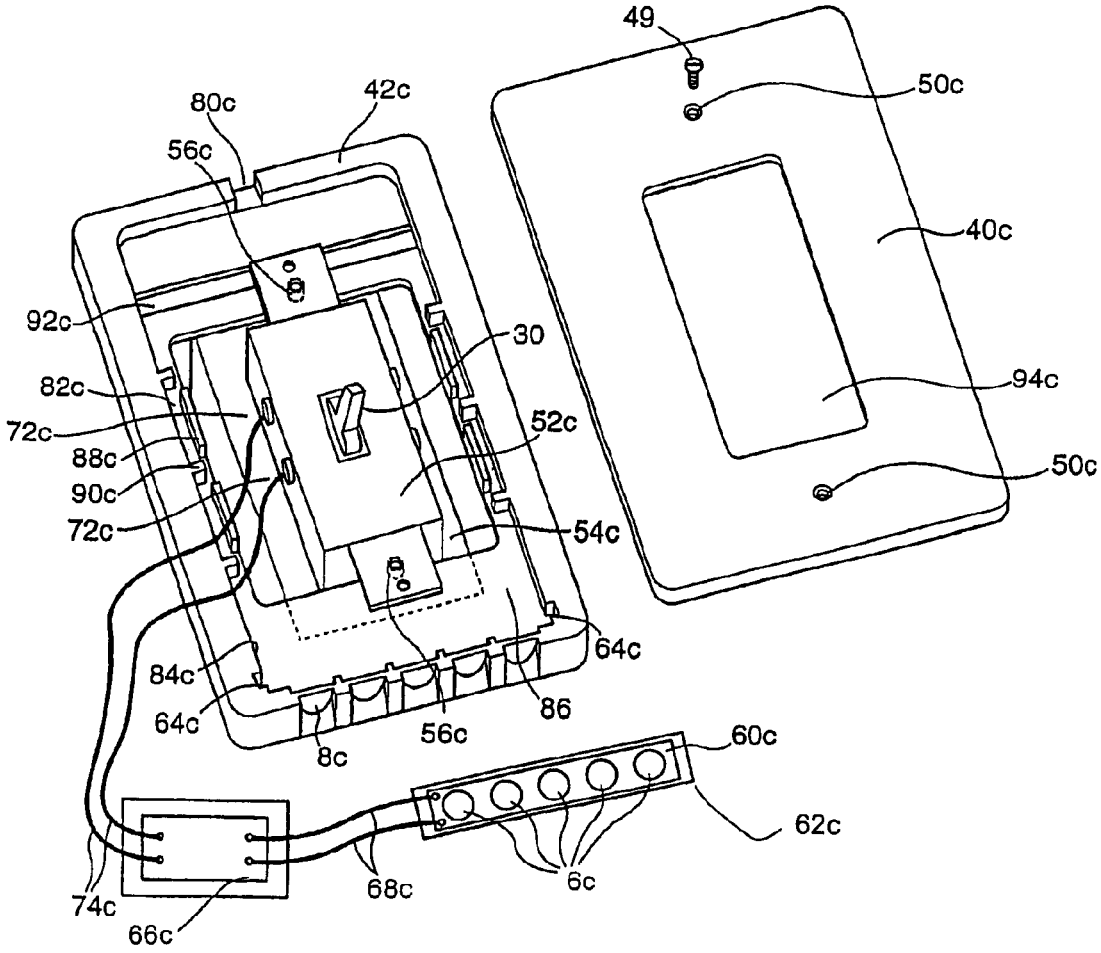
FIG. 12 is an exploded profile view of a frame assembly and light for an electrical outlet for an embodiment of FIG. 11.

Referring to FIG. 12, the layout of components of frame assembly 2*c* is similar to the layout for components for frame assembly 2*b* (FIGS. 3*a* and 3*b*). Light switch 52*c* is mounted to electrical box 54*c* via screws, not shown (but see screws 48, FIG. 3*b*), inserted hollow spacers 56*c* on frame 42*c*. Hollow spacers 56*c* allow light switch 52*c* to be flush with the front surface of cover 40*c*.

Lights 6*c* are part of light circuit 60*c*. Light circuit 60*c* is etched in printed circuit board 62*c* (PCB 62*c*). PCB 62*c* is mounted in frame 42*c* between slots 64*c* and is oriented to have lights 6*c* facing downward towards apertures 8*c*.

Light circuit 60*c* is supplied power by power circuit 66*c* which is connected to light circuit 60*c* by first connection wire pair 68*c*.

Power circuit 66*c* is mounted on second PCB 76*c*. Second PCB 76*c* is mounted in frame 42*c*. Wires 74*c* from power circuit 66*c* connect to terminals 72*c* of light switch 52*c*. Terminals 72*c* are connected to the household power supply (not shown).

It can be appreciated that power circuit 66*c* may include a light sensor circuit as described earlier to selectively activate light circuit 60*c* depending on the amount of ambient light detected. Conduit 80*c* is provided for access to ambient light in a similar manner to such conduits described earlier.

Wire routing channel 82*c* is formed by the interior lateral edges 84*c* of frame 42*c*, base plate 86*c* and side railings 88*c* extending upwardly from base plate 86*c*. Flanges 90*c* extending into the routing channel 82*c* from the interior lateral edge 84*c* provide friction fit contact points in routing channel 82*c* for wire pairs 68*c*, 74*c*.

Top railing 92*c* in frame 42*c* provides a physical barrier between second PCB 76*c* (when installed) and light switch 52*c* to protect light switch 52*c* from pieces from any failed component in power circuit 66*c*.

Cover 40*c* mounts on top of frame 42*c*, allowing access to switch actuator 30 of light switch 52*c* through opening 94*c*. Apertures 50*c* on cover 40*c* align with screw holes 92*c* on light switch 52*c*. Screws 49, or other suitable fasteners, may be used to secure cover 40*c* and wall outlet 52*c* together.

It is noted that those skilled in the art will appreciate that various modifications of detail bay be made to the preferred embodiment as described herein, which would come within the spirit an scope of the invention as defined in the following set of claims.

We claim:

1. A frame assembly and light for covering a wall conduit in a wall, the wall conduit having components requiring access outside the frame assembly, the frame assembly comprising:

a light;

an electrical circuit providing electrical energy to the light from a power source;

a rectangular frame through which the electrical component is accessible, the frame housing the electrical circuit, the frame having sides with a depth sufficient to house the light, and the frame having an aperature in at least one of the sides allowing the light to illuminate a space outside the frame assembly through the aperature; and a cover plate separate from the frame and for covering the frame and for providing access to the components of the wall conduit.

2. The frame assembly of claim 1 wherein the component is an electrical switch.

3. An assembly for use in association with a component having a connection to electrical power and requiring access during use to a portion of the component, and a separate rectangular cover for the component, the assembly comprising:

a rectangular frame through which the component is accessible, the rectangular frame having substantially the same external rectangular dimensions as the cover; and a light;

wherein the rectangular frame has sides that have sufficient depth to house the light, wherein at least one of the sides has an aperture for allowing the light to illuminate outside the frame through the aperture, wherein access through the frame to the component is dimensioned to be covered by the rectangular cover.

4. The assembly of claim 3, wherein the component is an electrical outlet with an electrical connection, and the electrical connection is that part of the electrical outlet that requires access during use.

5. The assembly of claim 3, wherein the component is an electrical switch with an electrical actuator, and the electrical actuator is that part of the electrical switch that requires access during use.

6. The assembly of claim 3, further comprising spacers extending from the frame for holding the component in a desired position relative to the cover.

7. The assembly of claim 3, further comprising:

a substantially flat base plate extending inwardly from the rectangular frame, the component being accessible through the rectangular frame while connected to the connection, and spacers extending from the base plate for holding the component with the base plate between the component and the conduit in a desired position relative to the cover.

8. The assembly of claim 6, wherein the spacers are hollow and the hollow is positioned such that fastening means may be inserted through the component and the hollow.

9. The assembly of claim 3, wherein the rectangular frame is dimensioned to cover a wall conduit for an electrical box.

10. The assembly of claim 4, wherein the rectangular frame is dimensioned to cover a wall conduit for an electrical box.

11. The assembly of claim 3, wherein the frame further houses a power circuit for powering the one or more lights from the electrical connection.

12. The assembly of claim 3, wherein the frame further houses a light sensor, the frame having sensor apertures through which the sensor senses ambient light external to the frame.

13. The assembly of claim 12, wherein the frame further houses a power circuit that powers the lights when the sensor senses that ambient light external to the frame is low.

14. The assembly of claim 13, wherein an additional light is housed within the frame and the frame has a corresponding aperture such that the additional light increases the ambient light received by the sensor.

15. The assembly of claim 3, wherein the light comprises a lighting emitting diode (LED).

16. The assembly of claim 15, wherein the LED is attached to a printed circuit board and the LED extends into the side aperture.

17. An assembly for use in association with a component having a connection to electrical power and requiring access during use to a portion of the component, the assembly comprising:

a rectangular frame through which the component is accessible; and a light;

wherein the rectangular frame has a side that has sufficient depth to house the light, and wherein the side has an aperture for allowing the light to illuminate outside the frame through the aperture, and wherein the light comprises a lighting emitting diode (LED), and wherein the LED is a plurality of LEDs and the side aperture is a series of side apertures, one aperture for each LED, and each LED extends into its respective side aperture.

18. The assembly of claim 17, wherein all of the LEDs are part of a light circuit and extend from a single printed circuit board that is powered by a separate power circuit.

19. The assembly of claim 12, wherein the sensor aperture is in a sensor side of the rectangular frame opposite the side of the rectangular frame having the light.

20. The assembly of claim 13, further comprises isolation means between the power circuit and the component in the event of power circuit failure.

21. The assembly of claim 20, wherein the frame houses a routing channel for wires connecting the power circuit and the lighting circuit such that the wires are physically separated from the component.

22. An assembly for use in association with a component having a connection to electrical power and requiring access during use to a portion of the component, and a separate rectangular cover for the component, the assembly comprising:

a rectangular frame through which the component is accessible, the rectangular frame having substantially the same external rectangular dimensions as the cover; and a light;

wherein the rectangular frame has a depth sufficient to house the light, wherein the frame has an aperture for allowing the light to illuminate outside the frame through the aperture, wherein the cover mounts on top of the frame, and the component mounts inside the frame to the assembly at the same depth as the cover mounts to the frame.

23. An assembly for use in association with a component having a connection to electrical power and requiring access during use to a portion of the component, and a separate rectangular cover for the component, the assembly comprising:

a rectangular frame through which the component is accessible, the rectangular frame having substantially the same external rectangular dimensions as the cover;

spacer means inside the frame; and a light;

wherein the rectangular frame has a depth sufficient to house the light, wherein the frame has an aperture for allowing the light to illuminate outside the frame through the aperture, wherein the cover mounts on top of the frame, and the spacer means are flush with the frame where the cover mounts, and wherein the component mounts on top of the spacer means.

24. An assembly for use in association with a component having a connection to electrical power and requiring access during use to a portion of the component, and a separate rectangular cover for the component, the assembly comprising:

a rectangular frame through which the component is accessible, the rectangular frame having substantially the same external rectangular dimensions as the cover;

spacer means inside the frame for holding the component in a desired position relative to the cover; and a light;

wherein the rectangular frame has a depth sufficient to house the light, wherein the frame has an aperture for allowing the light to illuminate outside the frame through the aperture, and wherein the cover mounts on top of the frame.

25. The assembly of claim 24, wherein the component is a wall outlet with electrical connections.

26. The assembly of claim 25, wherein the desired position places the connections substantially flush with a front surface of the cover.

27. The assembly of claim 24, wherein the component is an electrical switch.

* * * * *